US009953554B2

(12) United States Patent
Hu et al.

(10) Patent No.: US 9,953,554 B2
(45) Date of Patent: Apr. 24, 2018

(54) METHOD FOR OBTAINING COMPENSATION VALUE OF GRAY SCALE OF A PIXEL

(71) Applicant: Shenzhen China Star Optoelectronics Technology Co., Ltd., Shenzhen, Guangdong (CN)

(72) Inventors: Houliang Hu, Guangdong (CN); Liwei Zhu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/418,182

(22) PCT Filed: Jan. 20, 2015

(86) PCT No.: PCT/CN2015/071062
§ 371 (c)(1),
(2) Date: May 9, 2016

(87) PCT Pub. No.: WO2016/090733
PCT Pub. Date: Jun. 16, 2016

(65) Prior Publication Data

US 2016/0247432 A1 Aug. 25, 2016

(30) Foreign Application Priority Data

Dec. 10, 2014 (CN) ..... 2014 1 0752853

(51) Int. Cl.
*G09G 3/20* (2006.01)
*G09G 5/02* (2006.01)

(52) U.S. Cl.
CPC ..... *G09G 3/20* (2013.01); *G09G 5/02* (2013.01); *G09G 2310/027* (2013.01);
(Continued)

(58) Field of Classification Search
CPC ..... G09G 5/02; G09G 2360/16; G09G 2320/0242; G09G 2320/0276; G09G 2320/0693; G09G 3/20; G09G 2310/027
See application file for complete search history.

(56) References Cited

U.S. PATENT DOCUMENTS

2015/0187289 A1* 7/2015 Kim ..... G01M 11/064 345/89
2016/0267838 A1* 9/2016 Zhang ..... G09G 3/2003

FOREIGN PATENT DOCUMENTS

CN 101425273 A 5/2009
CN 101740000 A 6/2010
(Continued)

OTHER PUBLICATIONS

International Search Report and Written Opinion, dated Jan. 20, 2015, China.

(Continued)

*Primary Examiner* — Abhishek Sarma
(74) *Attorney, Agent, or Firm* — Kim Winston LLP

(57) ABSTRACT

Disclosed is a method for obtaining a compensation value of gray scale of a pixel. The method comprises steps of: acquiring a display area of a display panel; dividing the display area equally into a plurality of first sub-areas according to a first preset rule, each of the first sub-areas comprising at least two pixels; obtaining pre-stored multinomial coefficients of each of the first sub-areas, and according to a second preset rule, establishing a multinomial corresponding to each of the first sub-areas; and obtaining a value range of an independent variable of the multinomial, and according to a corresponding multinomial, obtaining a compensation value of gray scale of each of the first sub-areas.

11 Claims, 6 Drawing Sheets

(52) U.S. Cl.
CPC ..... *G09G 2320/0242* (2013.01); *G09G 2320/0276* (2013.01); *G09G 2320/0693* (2013.01); *G09G 2360/16* (2013.01)

(56) References Cited

FOREIGN PATENT DOCUMENTS

| | | | |
|---|---|---|---|
| CN | 102262868 | A | 11/2011 |
| CN | 102723054 | A | 10/2012 |
| CN | 103310765 | A | 9/2013 |
| CN | 104157256 | A | 11/2014 |
| JP | 2012037862 | A | 2/2012 |
| TW | 200847123 | A | 12/2008 |
| TW | 200923873 | A | 6/2009 |

OTHER PUBLICATIONS

Chinese Office Action and Search Report, dated Mar. 25, 2016, China.

* cited by examiner

METHOD FOR OBTAINING COMPENSATION VALUE OF GRAY SCALE OF A PIXEL

The present application claims benefit of Chinese patent application CN201410752853.0, entitled "Method for obtaining compensation value of gray scale of a pixel" and filed on Dec. 10, 2014, the entirety of which is incorporated herein by reference.

TECHNICAL FIELD

The present disclosure relates to the technical field of displays, and in particular, to a method for obtaining compensation value of gray scale of a pixel.

TECHNICAL BACKGROUND

In the process of manufacturing display panels, display panels might suffer with mura, such as dot, line, strap, or area, due to the deficiency of manufacturing process or materials. Mura can be partly eliminated through compensation of gray scale by means of adjustment of the voltage of external circuits, or by means of a mura processing structure in the downstream process, thereby improving the non-defective rate of display panels.

In the mura processing structure, the compensation values of gray scale of the corresponding muras can be obtained by image processing, and then each of the compensation values of gray scale can be stored in the mura processing structure for being directly called when the gray scale is compensated. At present, the mura processing structure can be implemented through hardware by providing a storage space corresponding to the resolution of the display panel, which requires a large storage space of the mura processing structure, and therefore increases the hardware costs of the mura processing structure.

SUMMARY OF THE INVENTION

The objective of the present disclosure is to provide a method for obtaining compensation value of gray scale of a pixel so as to decrease the storage pace of the mura processing structure.

The present disclosure provides a method for obtaining compensation value of gray scale of a pixel. The method comprises steps of: acquiring a display area of a display panel; dividing the display area equally into a plurality of first sub-areas according to a first preset rule, each of the first sub-areas comprising at least two pixels; obtaining pre-stored multinomial coefficients of each of the first sub-areas, and establishing a multinomial corresponding to each of the first sub-areas according to a second preset rule; and obtaining a value range of an independent variable of the multinomial, and according to a corresponding multinomial, obtaining a compensation value of gray scale of each of the first sub-areas.

The method further comprises a step of determining the multinomial coefficients of the first sub-areas, and storing the determined multinomial coefficients.

The step of determining the multinomial coefficients of the first sub-areas comprises: acquiring the display area of the display panel; dividing the display area equally into a plurality of first sub-areas according to the first preset rule, each of the first sub-areas comprising at least two pixels; dividing each of the first sub-areas equally into a plurality of second sub-areas; obtaining an average compensation value of gray scale of pixels in each of the second sub-areas; establishing a first matrix for each of the first sub-areas based on arrangement of each of the second sub-areas therein, each element of the first matrix being the average compensation value of gray scale of each of the second sub-areas; establishing a corresponding fitting surface according to each of the first matrices and the second preset rule; and obtaining a multinomial about a row number and a column number of the elements in the first matrix according to the fitting surface, so as to determine the multinomial coefficients of each of the first sub-areas.

The method further comprises, after obtaining the value range of the independent variable of the multinomial, and according to the corresponding multinomial, obtaining the compensation value of gray scale of each of the first sub-areas: integrating each of the first matrices according to arrangement of each of the first sub-areas to form a second matrix; expanding the second matrix, the row number of the expanded second matrix equaling the number of the pixels in each row of the display area, and the column number of the expanded second matrix equaling the number of the pixels in each column of the display area; and processing the expanded second matrix by a smooth filter to obtain a corresponding compensation value of gray scale of each of the pixels, and then compensating the gray scale.

The step of expanding the second matrix comprises: copying and tiling each of the elements of the second matrix to obtain a block corresponding to the element, the row number and the column number of the block being the same as those of the second sub-areas respectively; and integrating the blocks corresponding to each of the elements to obtain an expanded second matrix based on arrangement of each of the elements.

The step of determining the multinomial coefficients of the first sub-areas comprises: acquiring the display area of the display panel; dividing the display area equally into a plurality of first sub-areas according to the first preset rule, each of the first sub-areas comprising at least two pixels; obtaining a compensation value of gray scale of each of the pixels in each of the first sub-areas; establishing a third matrix for each of the first sub-areas based on arrangement of each of the pixels therein; establishing a corresponding fitting surface according to each of the third matrices and the second preset rule; and obtaining a multinomial about a row number and a column number of the elements in the third matrix according to the fitting surface, so as to determine the multinomial coefficients of each of the first sub-areas.

The first preset rule includes the number of pixels in each row and in each column of each of the first sub-areas, or the number of the first sub-areas.

The second preset rule includes a general formula of the multinomial.

The step of processing the expanded second matrix by a smooth filter comprises smoothing the expanded matrix with a low pass filter.

The multinomial has two independent variables, which are respectively the row number and the column number of the elements in the first matrix.

The multinomial has two independent variables, which are respectively the row number and the column number of the element in the third matrix.

The present disclosure achieves the following beneficial effects. According to the method for obtaining compensation value of gray scale of a pixel provided by embodiments of the present disclosure, the compensation value of gray scale of each of the first sub-areas can be obtained based merely on the pre-stored multinomial coefficients of each of the first sub-areas, the first preset rule, the second preset rule, and the value range of the independent variable of the multinomial. Compared with the existing technologies, the method according to the present disclosure can distinctly decrease the storage space of the mura processing structure, thereby reducing the hardware costs of the mura processing structure.

Other features and advantages of the present disclosure will be further explained in the following description, and will partly become self-evident therefrom, or be understood through the implementation of the present disclosure. The objectives and advantages of the present disclosure will be achieved through the structures specifically pointed out in the description, claims, and the accompanying drawings.

BRIEF DESCRIPTION OF THE DRAWINGS

For further illustrating the technical solutions provided in the embodiments of the present disclosure, a brief introduction will be given below to the accompanying drawings involved in the embodiments.

DETAILED DESCRIPTION OF THE EMBODIMENTS

Figure 1:
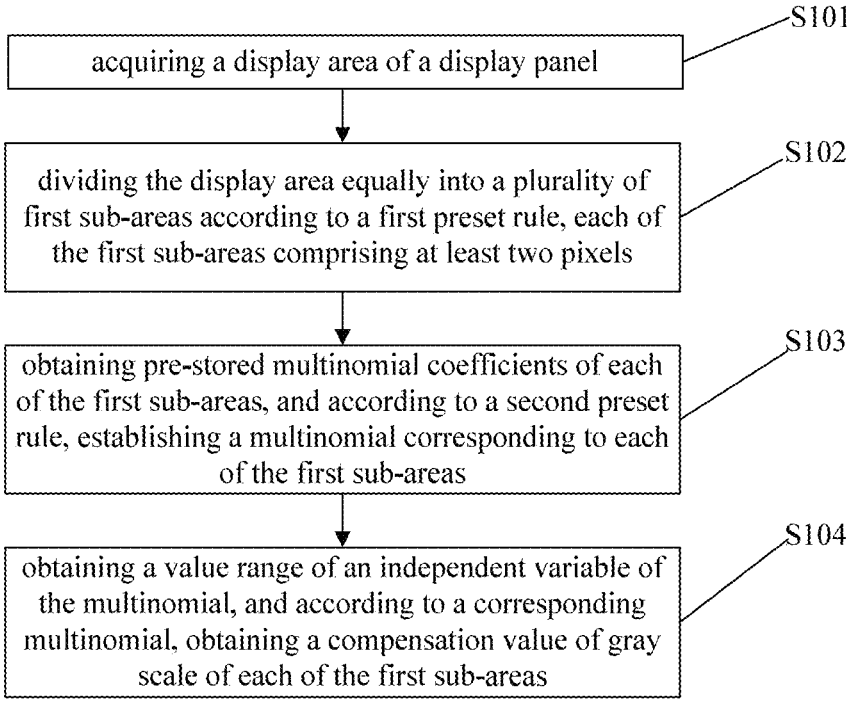
FIG. 1 is a flow chart of a method for obtaining compensation value of gray scale of a pixel according to the embodiments of the present disclosure.

The present embodiment provides a method for obtaining compensation value of gray scale of a pixel. As shown in FIG. 1, the method comprises the following steps.

In step S101, a display area of a display panel is obtained. That is, the resolution of the display panel is determined, so as to determine the number of the pixels of which the compensation value of gray scale is to be obtained. In the present embodiment, it is supposed that the resolution of the display panel is M×N, wherein M and N are positive integers.

In step S102, according to a first preset rule, the display area is divided equally into a plurality of first sub-areas, each of the first sub-areas comprising at least two pixels. The first preset rule includes the number of pixels in each row and in each column of each of the first sub-areas 1. The first preset rule can also include the number of the first sub-areas, i.e., indicating how many first sub-areas 1 the display area of the display panel should be equally divided into. In the present embodiment, the former one of the first preset rule is adopted.

In step S103, pre-stored multinomial coefficients of each of the first sub-areas are obtained, and according to a second preset rule, a multinomial corresponding to each of the first sub-areas is established.

In the present embodiment, multinomial coefficients corresponding to each of the first sub-areas 1 are pre-stored, and then are called in processing each of the first sub-areas 1 one by one. After that, multinomial coefficients of different first sub-areas 1 are substituted into a general formula of the multinomial provided by the second preset rule, thereby obtaining a multinomial with respect to each of the first sub-areas.

The multinomial coefficient of each of the first sub-areas 1 can be stored in the form of a table in a hardware structure, which is used for the obtaining of the compensation value of gray scale, for ease of being called, and for preventing the occurrence of non-correspondence between the first sub-area 1 and the multinomial coefficient when they are called.

The highest degree of the multinomial can be selected based upon actual situation. In the present embodiment, the multinomial is preferably a four-order multinomial, and the multinomial coefficient is usually kept the fourth decimal place for reducing compensation errors.

In step S104, a value range of an independent variable of the multinomial is obtained, and according to a corresponding multinomial, a compensation value of gray scale of each of the first sub-areas is obtained.

According to the value range of the independent variable of the multinomial, the compensation value of gray scale of each of the first sub-areas 1 can be obtained. Then, according to a pre-stored voltage coefficient of compensation value of gray scale, a compensation voltage of gray scale of each of the first sub-areas 1 can be obtained through calculation. Thus, each of the first sub-areas 1 can be compensated.

Obviously, according to the method for obtaining compensation value of gray scale of a pixel provided by the present embodiment, the compensation value of gray scale of each of the first sub-areas 1 can be obtained based merely on the pre-stored multinomial coefficients of each of the first sub-areas, the first preset rule, the second preset rule, and the value range of the independent variable of the multinomial. Compared with the existing technologies, the method according to the present embodiment can distinctly decrease the storage space of the mura processing structure, thereby reducing the hardware costs of the mura processing structure.

In the following, how the present embodiment contributes towards reducing the storage space of the mura processing structure by means of specific data will be illustrated.

As aforementioned, in the present embodiment, the resolution of the display panel is M×N. And it is supposed that the gray scale depth is eight bit, and that in the mura processing structure of the display panel five discontinuous compensation value coefficients of gray scale have been stored. Other compensation value coefficients of gray scale can be obtained by interpolation method according to the five compensation value coefficients of gray scale.

In the existing technologies, since a corresponding storage space of each of the pixels should be provided, the storage space of the display panel with respect to the pixels should be: S=M*N*8*5 bit. If M=3,840, N=2,160, then S=3,840*2,160*8*5 bit=331,776,000 bit=40,500 Kbyte (1 byte=8 bit), which, obviously, is not a small storage space.

According to the technical solution provided by the present disclosure, since the space occupied by the first preset rule, the second preset rule, and the value range of the independent variable of the multinomial is small, it can thus be neglected. Supposing that the multinomial is a four-order multinomial, then each of the multinomials demands fifteen coefficients correspondingly. Supposing that the maximum value of the integer part of each of the multinomial coefficients is 254 (which is applicable to most of the display panels), and that each of the multinomial coefficients is kept the fourth decimal place, then the maximum value of each of the multinomial coefficients can be 254.9999. Considering that the mura processing structure usually adopts binary numbers, for each of the multinomial coefficients, there will be:

$$254.9999\times 2^{14}=4{,}177{,}918.3616$$

Hence, the maximum integer of each of the multinomial coefficients to be stored is 4,177,919, which can be presented as a binary number 11 1111 1011 1111 1111 1111. For each of the multinomial coefficients, a corresponding storage space thereof is: $S_1$=22 bit. Therefore, the storage space needed by fifteen multinomial coefficients is totally: $S_2=S_1\times 15$=330 bit. For display panels of which M=3,840, N=2,160, supposing that there are sixteen pixels respectively in each row and in each column of each of the first sub-areas 1, then there are altogether $(3{,}840\times 2{,}160)/16^2$=32,400 first sub-areas 1. Hence, for the display panel, the storage space required by all of the first sub-areas 1 is:

$$S_3=S_2\times 32{,}400=10{,}692{,}000 \text{ bit}=1{,}336{,}500 \text{ Byte}=1{,}305.18 \text{ KByte}$$

The same as the above example, with respect to each of the first sub-areas 1, five non-continuous compensation value coefficients of gray scale are stored. Thus, the storage space needed by each display panel is:

$$S_4=S_3\times 5=6{,}525.88 \text{ Kbyte}$$

From the above, it can be concluded that the storage space has been greatly reduced by the method for obtaining compensation value of gray scale of a pixel provided by the embodiments of the present disclosure. In addition, the storage space can be further reduced by adjusting the first preset rule, the second preset rule and so on, so as to further decrease the storage capacity of the mura processing structure, thereby reducing the costs of the mura processing structure.

Obviously, according to the technical solution provided by the present embodiment, before implementing the method as shown in FIG. 1, the multinomial coefficients of each of the first sub-areas 1 should be determined, and the determined multinomial coefficients should be stored, so that the determined multinomial coefficients can be directly called when the method in FIG. 1 is implemented.

Figure 2:
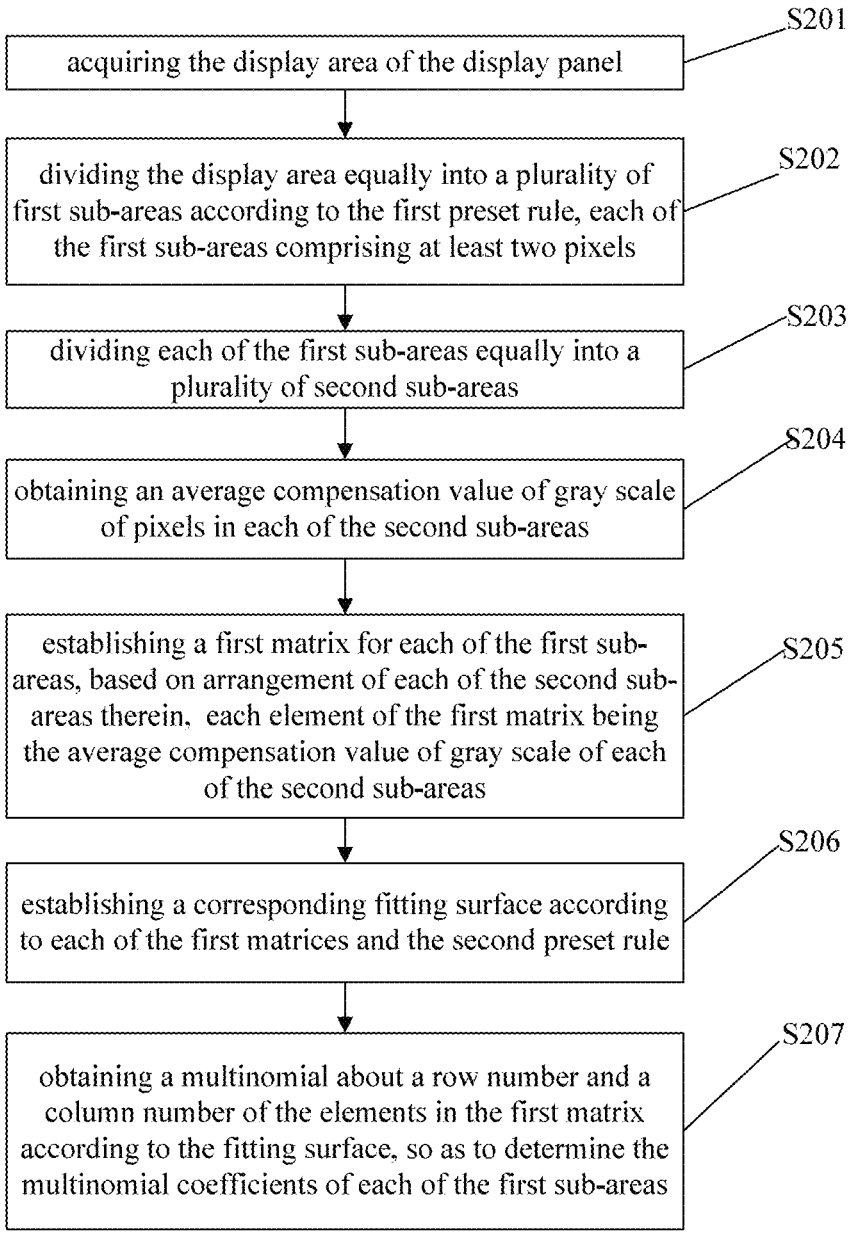
FIG. 2 is another flow chart of the method for obtaining compensation value of gray scale of a pixel according to the embodiments of the present disclosure.

Specifically, as shown in FIG. 2, the method of determining the multinomial coefficients of each of the first sub-areas 1 comprises the following steps:

In step S201, the display area of the display panel is obtained.

In step S202, according to the first preset rule, the display area is divided equally into a plurality of first sub-areas, each of the first sub-areas comprising at least two pixels.

Steps S201 and S202 equal to steps S101 and S102 in FIG. 1 respectively, and therefore will not be described herein in details.

In step S203, each of the first sub-areas is divided equally into a plurality of second sub-areas.

Figure 3:
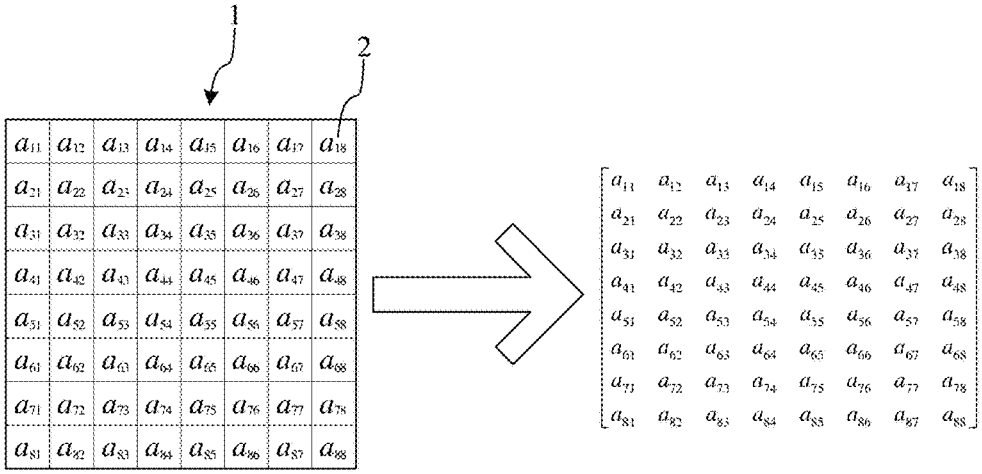
FIG. 3 schematically shows establishing a first matrix according to the embodiments of the present disclosure.

When the first sub-area 1 contains many pixels, for example, each row and each column of the first sub-area 1 include respectively 16 pixels, in order to obtain a more concise multinomial coefficient and reduce the data to be processed, as shown in FIG. 3, each of the first sub-areas 1 can be divided equally into a plurality of second sub-areas 2. For instance, each of the first sub-areas 1 can be divided equally into sixty-four second sub-areas 2. In this case, each second sub-area 2 will contain $16^2/64$=4 pixels, i.e., each row and each column of each of the second sub-areas contain respectively 2 pixels.

In step S204, an average compensation value of gray scale of pixels in each of the second sub-areas is obtained. That is, the compensation values of gray scale of the pixels in each of the second sub-areas are obtained, and then averaged, obtaining the average compensation value of gray scale.

In step S205, with respect to each of the first sub-areas, based on arrangement of each of the second sub-areas therein, a first matrix is established, and each element of the first matrix is the average compensation value of gray scale of each of the second sub-areas.

As shown in FIG. 3, after the average compensation value of gray scale ($a_{cd}$, wherein c and d are an integer from one to eight) of each of the second sub-areas is obtained, a first matrix is established based on arrangement of each of the second sub-areas 2 in the first sub-area 1.

In step S206, according to each of the first matrices and the second preset rule, a corresponding fitting surface is established.

Specifically, the number of the fitting surfaces established should equal to the number of the first matrices, i.e., a first matrix corresponds to a respective fitting surface.

Figure 4:
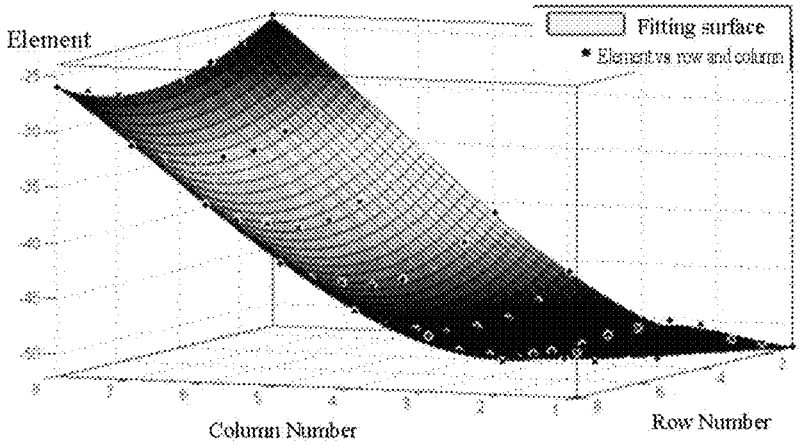
FIG. 4 shows a fitting surface according to the embodiments of the present disclosure.

As shown in FIG. 4, with respect to the first matrix as shown in FIG. 3, a fitting surface is established. The fitting surface conforms to the second preset rule, namely, the general formula of a multinomial. Regarding the first matrix with eight rows and eight columns as shown in FIG. 3, since the four-order multinomial requires less calculation, and has a better fitting effect, the present embodiment adopts preferably a four-order multinomial. The general formula of the four-order multinomial is as follows:

$$f(x,y)=p_{00}+p_{10}x+p_{01}y+p_{20}x^2+p_{11}xy+p_{02}y^2+p_{30}y^3+p_{21}x^2y+p_{12}xy^2+p_{03}x^4+p_{40}x^4+p_{31}x^3y+p_{22}x^2y^2+p_{13}xy^3+p_{04}y^4$$

In the formula above, $p_{00}$, $p_{10}$ . . . are the multinomial coefficients of the multinomial, and there are fifteen multinomial coefficients. x and y are the independent variables of the multinomial. In this case, the multinomial has two independent variables, namely, x and y, which are respectively the row number and column number of the elements of the first matrix.

In FIG. 4, each dot corresponds to an element of the first matrix. The sum of squares due to error (SSE) between the fitting surface fitted by the four-order multinomial and each of the elements in the first matrix is 4.292, the mean squared error (MSE) is 0.067, and the determination coefficient R-square is 0.991, indicating a desirable fitting effect of each of the elements of the first matrix by the fitting surface.

In step S207, according to the fitting surface, a multinomial about a row number and a column number of the elements of the first matrix is obtained, so as to determine the multinomial coefficients of each of the first sub-areas.

Based on the fitting surface in FIG. 4 and the four-order multinomial, the exact value of the fifteen multinomial coefficients in the four-order multinomial can be obtained. To ensure accuracy of the four-order multinomial, each of the multinomial coefficients should be kept at least the fourth decimal place.

After the multinomial coefficients are obtained, the method for obtaining compensation value of gray scale of a pixel as shown in FIG. 1 can be implemented.

Figure 5:
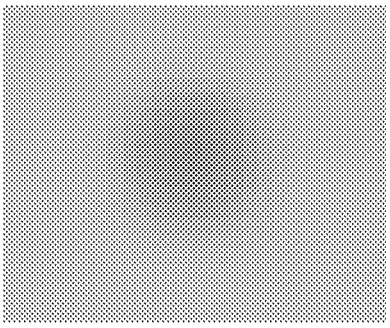
FIG. 5 shows an effect picture of compensating gray scale according to the embodiments of the present disclosure.
Figure 6:
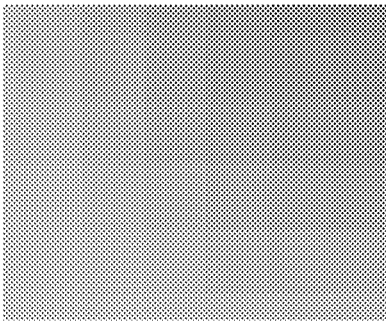
FIG. 6 is a partially enlarged view of FIG. 5.

Specifically, for the first sub-areas 1 at this moment, the compensation value of gray scale obtained by the multinomial coefficients is the compensation value of gray scale of the second sub-area, rather than the compensation value of gray scale of a pixel. As shown in FIG. 5, if the gray scale is compensated directly by the compensation value of gray scale obtained by the multinomial coefficients, there might be blocks as shown in FIG. 6, affecting the display effect of the display panel.

Figure 7:
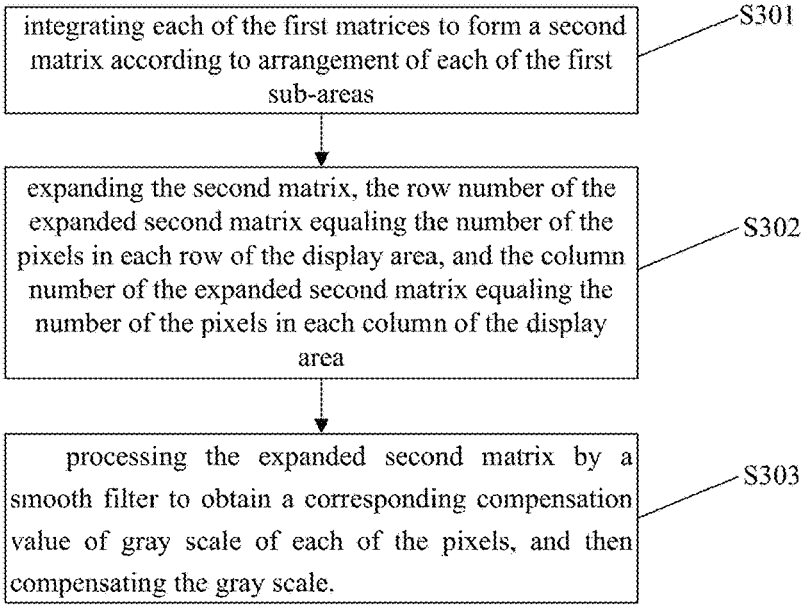
FIG. 7 is a further flow chart of the method for obtaining compensation value of gray scale of a pixel according to the embodiments of the present disclosure.

To ensure the display quality of the display panel, in the present embodiment, as shown in FIG. 7, after step S104, there are also the following steps.

In step S301, according to arrangement of each of the first sub-areas, the first matrices are integrated to form a second matrix. That is, each of the first matrices is a sub-matrix of the second matrix, and the second matrix is composed of these sub-matrices and established with a process similar to the process of establishing the first matrix as shown in FIG. 3.

In step S302, the second matrix is expanded. The row number of the expanded second matrix equals the number of the pixels in each row of the display area, and the column number of the expanded second matrix equals the number of the pixels in each column of the display area.

Figure 8:
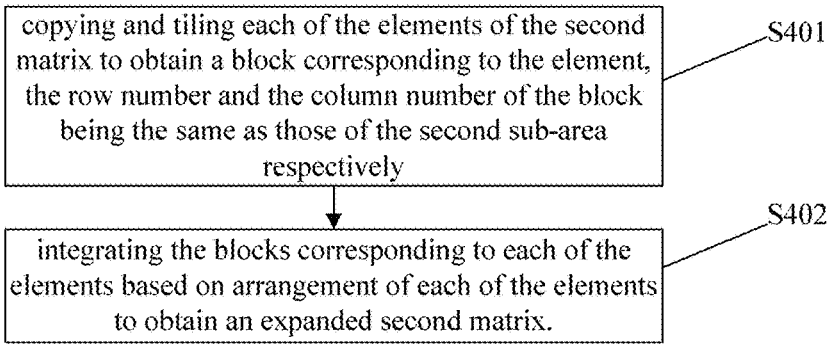
FIG. 8 is a still further flow chart of the method for obtaining compensation value of gray scale of a pixel according to the embodiments of the present disclosure.

Specifically, as shown in FIG. 8, the second matrix can be expanded with the following method.

In step S401, each of the elements of the second matrix is copied and tiled to obtain a corresponding block of the element, the row number and column number of the block being the same as those of the second sub-area respectively.

Figure 9:
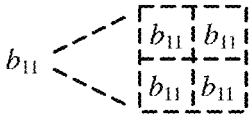
FIG. 9 schematically shows copying and tiling elements according to the embodiments of the present disclosure.

As shown in FIG. 9, it is supposed that the second matrix has j×k elements. The element $b_{11}$ of the second matrix is copied and tiled. Since the row number and column number of the second sub-areas are both 2, the element $b_{11}$ is copied and tiled to form a 2×2 block. Other elements of the second matrix are processed with the same method.

In step S402, based on arrangement of each of the elements, the blocks of the elements are integrated to obtain an expanded second matrix.

Figure 10:
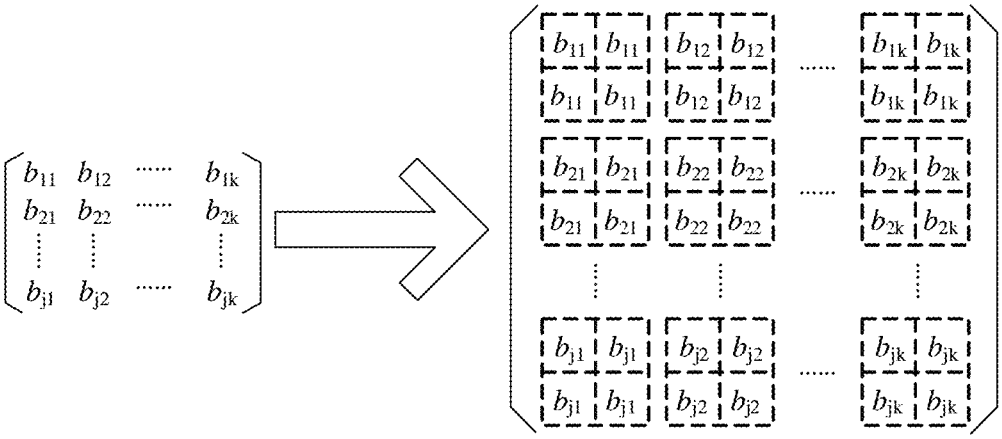
FIG. 10 schematically shows expanding a second matrix according to the embodiments of the present disclosure.

As shown in FIG. 10, the second matrix has j×k elements originally, wherein j refers to the ratio of the number of the pixels in each row of the display panel to the number of the pixels in each row of the second sub-area, and at this moment, j is M/2. Similarly, k refers to the ratio of the number of the pixels in each column of the display panel to the number of the pixels in each column of the second sub-area, and at this moment, k is N/2. After the blocks of the elements, such as $b_{11}$, are integrated, the block of each of the elements is placed at a position corresponding to a respective element, thereby obtaining the expanded second matrix.

Obviously, the total number of the elements of the expanded second matrix is the same as that of the elements of the display panel.

In step S303, the expanded second matrix is processed by a smooth filter to obtain a corresponding compensation value of gray scale of each of the pixels, and then the gray scale is compensated.

The smooth filtering is performed preferably with a low pass filter, especially a low pass filter of which the row number and the column number are the same as those of the second matrix, and the elements thereof are the reciprocals of the product of the row numbers and the column numbers.

As for the aforesaid second matrix with 2 rows and 2 columns, it should be processed with a low pass filter as follows:

$$\begin{bmatrix} \frac{1}{4} & \frac{1}{4} \\ \frac{1}{4} & \frac{1}{4} \end{bmatrix}.$$

Figure 11:
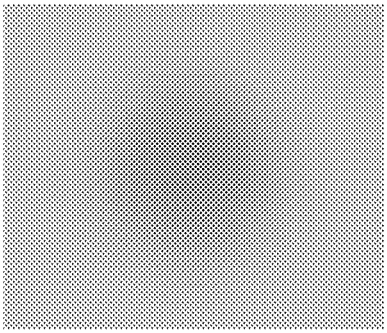
FIG. 11 shows another effect picture of compensating gray scale according to the embodiments of the present disclosure.
Figure 12:
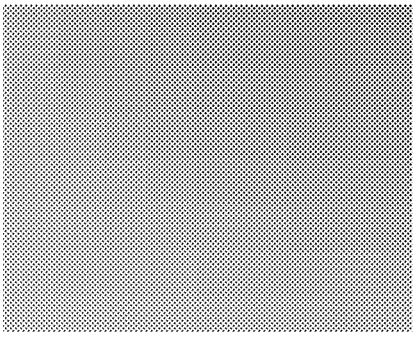
FIG. 12 is a partially enlarged view of FIG. 11.

Each element of the second matrix processed by the smooth filter corresponds to the compensation value of gray scale of the pixel at a corresponding position of the display panel. As shown in FIG. 11, after the gray scale is compensated according to each of the elements of the second matrix, there is no obvious block even if it is enlarged as shown in FIG. 12.

It should be explained that, in the above steps, the first matrix can also be expanded first, then all the expanded first matrixes can be integrated to form a second matrix, and subsequently, the second matrix is processed by a smooth filter. However, the steps in the present embodiment are not restricted to the above.

Figure 13:
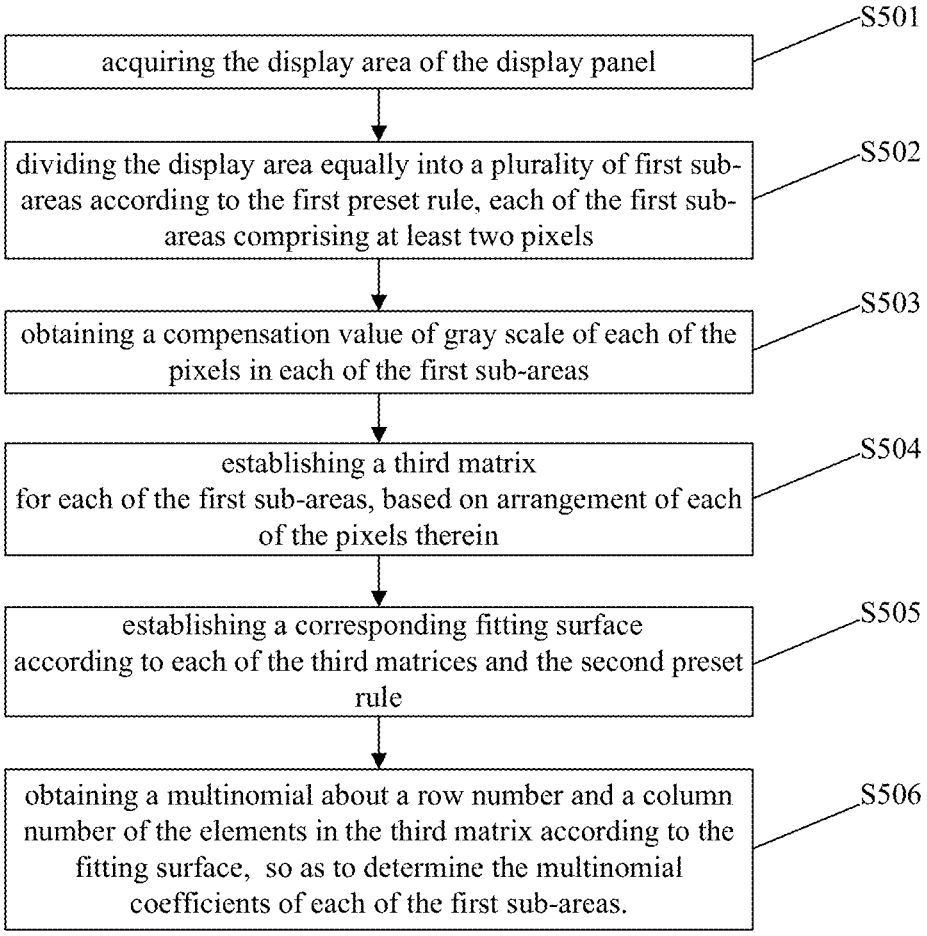
FIG. 13 is a still further flow chart of the method for obtaining compensation value of gray scale of a pixel according to the embodiments of the present disclosure.

Further, for display panels with a lower resolution, or display panels having a first sub-area which is divided very precisely, if each of the first sub-areas contains only few pixels (e.g. four), there is no need to divide the first sub-areas 1 further when the multinomial coefficients of the first sub-areas 1 is determined, Instead, the multinomial coefficients can be determined directly by the compensation value of gray scale of each pixel in the first sub-areas 1. Specifically, as shown in FIG. 13, the method for determining the multinomial coefficients comprises the following steps.

In step S501, the display area of the display panel is obtained.

In step S502, according to the first preset rule, the display area is divided equally into a plurality of first sub-areas, each of the first sub-areas comprising at least two pixels.

In step S503, a compensation value of gray scale of each of the pixels in each of the first sub-areas is obtained.

In step S504, with respect to each of the first sub-areas, based on arrangement of each of the pixels therein, a third matrix is established.

In step S505, according to the third matrices and the second preset rule, a corresponding fitting surface is established.

In step S506, according to the fitting surface, a multinomial about a row number and a column number of the element in the third matrix is obtained, so as to determine the multinomial coefficients of each of the first sub-areas.

Similarly, in this case, the multinomial has two independent variables, namely, x and y, which are respectively the row number and column number of the third matrix.

Figure 14:
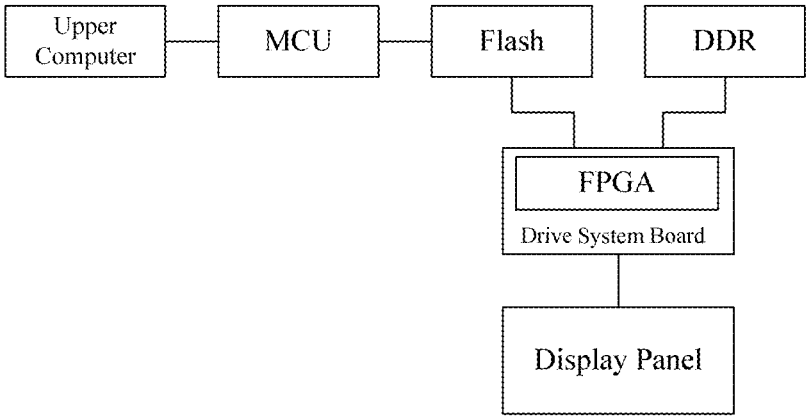
FIG. 14 schematically shows a mura processing structure according to the embodiments of the present disclosure.

In the present embodiment, the multinomial coefficients of the first sub-areas 1 can be provided to a lookup table. Then, as shown in FIG. 14, by means of an upper computer, the data of the lookup table can be burned to the flash of the drive system board of the display panel by means of a micro control unit (MCU). When the compensation value of gray scale needs to be obtained, the field-programmable gate array (FPGA) of the drive system board reads the multinomial coefficients in the flash, and writes them to the double data rate (DDR). After that, the FPGA figures out the compensation value of gray scale by means of the multinomial coefficients, corrects the compensation value of gray scale, and displays the final compensation value of gray scale on the display panel.

The above embodiments are described only for better understanding, rather than restricting the present disclosure. Anyone skilled in the art can make amendments to the implementing forms or details without departing from the spirit and scope of the present disclosure. The scope of the present disclosure should still be subject to the scope defined in the claims.

The invention claimed is:

1. A method for obtaining a compensation value of gray scale of a pixel, comprising:

acquiring a display area of a display panel, dividing the display area equally into a plurality of first sub-areas according to a first preset rule, each of the first sub-areas comprising at least two pixels, obtaining pre-stored multinomial coefficients of each of the first sub-areas, and according to a second preset rule, establishing a multinomial corresponding to each of the first sub-areas, obtaining a value range of an independent variable of the multinomial, and according to a corresponding multinomial, obtaining a compensation value of gray scale of each of the first sub-areas, and determining the multinomial coefficients of the first sub-areas, and storing the determined multinomial coefficients, wherein determining the multinomial coefficients of the first sub-areas comprises:

acquiring the display area of the display panel, dividing the display area equally into a plurality of first sub-areas according to the first preset rule, each of the first sub-areas comprising at least two pixels, dividing each of the first sub-areas equally into a plurality of second sub-areas, obtaining an average compensation value of gray scale of pixels in each of the second sub-areas, establishing a first matrix for each of the first sub-areas, based on arrangement of the second sub-areas therein, each element of the first matrix being the average compensation value of gray scale of each of the second sub-areas, establishing a corresponding fitting surface according to each of the first matrices and the second preset rule, and obtaining a multinomial about a row number and a column number of the elements in the first matrix according to the fitting surface, so as to determine the multinomial coefficients of each of the first sub-areas.

2. The method according to claim 1, further comprising, after obtaining the value range of the independent variable of the multinomial, and according to the corresponding multinomial, obtaining the compensation value of gray scale of each of the first sub-areas:

integrating each of the first matrices according to arrangement of each of the first sub-areas to form a second matrix, expanding the second matrix, the row number of the expanded second matrix equaling the number of the pixels in each row of the display area, and the column number of the expanded second matrix equaling the number of the pixels in each column of the display area, and processing the expanded second matrix by a smooth filter to obtain a corresponding compensation value of gray scale of each of the pixels, and then compensating the gray scale.

3. The method according to claim 2, wherein expanding the second matrix comprises:

copying and tiling each of the elements of the second matrix to obtain a block corresponding to the element, the row number and the column number of the block being the same as those of the second sub-area respectively, and integrating the blocks corresponding to each of the elements based on arrangement of each of the elements to obtain an expanded second matrix.

4. The method according to claim 1, wherein the first preset rule includes the number of pixels in each row and in each column of each of the first sub-areas, or the number of the first sub-areas.

5. The method according to claim 1, wherein the second preset rule includes a general formula of the multinomial.

6. The method according to claim 2, wherein processing the expanded second matrix by the smooth filter comprises smoothing the expanded matrix with a low pass filter.

7. The method according to claim 1, wherein the multinomial has two independent variables, which are respectively the row number and the column number of the element of the first matrix.

8. A method for obtaining a compensation value of gray scale of a pixel, comprising:

acquiring a display area of a display panel, dividing the display area equally into a plurality of first sub-areas according to a first preset rule, each of the first sub-areas comprising at least two pixels, obtaining pre-stored multinomial coefficients of each of the first sub-areas, and according to a second preset rule, establishing a multinomial corresponding to each of the first sub-areas, obtaining a value range of an independent variable of the multinomial, and according to a corresponding multinomial, obtaining a compensation value of gray scale of each of the first sub-areas, and determining the multinomial coefficients of the first sub-areas, and storing the determined multinomial coefficients, wherein determining the multinomial coefficients of the first sub-areas comprises:

acquiring the display area of the display panel, dividing the display area equally into a plurality of first sub-areas according to the first preset rule, each of the first sub-areas comprising at least two pixels, obtaining a compensation value of gray scale of each of the pixels in each of the first sub-areas, establishing a third matrix for each of the first sub-areas, based on arrangement of the pixels therein, establishing a corresponding fitting surface according to each of the third matrices and the second preset rule, and obtaining a multinomial about a row number and a column number of the elements in the third matrix according to the fitting surface, so as to determine the multinomial coefficients of each of the first sub-areas.

9. The method according to claim 8, wherein the multinomial has two independent variables, which are respectively the row number and the column number of the element of the third matrix.

10. The method according to claim 8, wherein the first preset rule includes the number of pixels in each row and in each column of each of the first sub-areas, or the number of the first sub-areas.

11. The method according to claim 8, wherein the second preset rule includes a general formula of the multinomial.

* * * * *